US008600088B2

(12) United States Patent
Rasmussen

(10) Patent No.: US 8,600,088 B2
(45) Date of Patent: Dec. 3, 2013

(54) HEARING DEVICE, HEARING DEVICE SYSTEM AND METHOD OF CONTROLLING THE HEARING DEVICE SYSTEM

(75) Inventor: Karsten Bo Rasmussen, Smørum (DK)

(73) Assignee: OTICON A/S, Smorum (DK)

( * ) Notice: Subject to any disclaimer, the term of this patent is extended or adjusted under 35 U.S.C. 154(b) by 1036 days.

(21) Appl. No.: 12/333,202

(22) Filed: Dec. 11, 2008

(65) Prior Publication Data

US 2009/0154742 A1 Jun. 18, 2009

(30) Foreign Application Priority Data

Dec. 14, 2007 (EP) ..... 07123203

(51) Int. Cl.
*H04R 25/00* (2006.01)

(52) U.S. Cl.
USPC ..... 381/318; 381/23.1; 381/312; 381/315

(58) Field of Classification Search
USPC ..... 381/23.1, 312, 315, 318
See application file for complete search history.

(56) References Cited

U.S. PATENT DOCUMENTS

| | | | |
|---|---|---|---|
| 5,086,464 | A | 2/1992 | Groppe |
| 2004/0052391 | A1 | 3/2004 | Bren et al. |
| 2004/0252855 | A1 | 12/2004 | Vasserman et al. |
| 2005/0117764 | A1 | 6/2005 | Arndt et al. |
| 2005/0175202 | A1 | 8/2005 | Moo et al. |
| 2006/0013420 | A1 | 1/2006 | Sacha |
| 2007/0076910 | A1* | 4/2007 | Sporer ..... 381/312 |
| 2007/0230714 | A1* | 10/2007 | Armstrong ..... 381/74 |
| 2008/0025537 | A1* | 1/2008 | Ritter et al. ..... 381/314 |

FOREIGN PATENT DOCUMENTS

| | | | |
|---|---|---|---|
| EP | 1202538 | A2 | 5/2002 |
| EP | 1416765 | A2 | 5/2004 |
| EP | 1699261 | A1 | 9/2006 |
| WO | WO-00/64216 | A1 | 10/2000 |
| WO | WO-00/65873 | A1 | 11/2000 |

* cited by examiner

*Primary Examiner* — Yu Chen
(74) *Attorney, Agent, or Firm* — Birch, Stewart, Kolasch & Birch, LLP

(57) ABSTRACT

The present invention refers to a hearing device system which comprises: at least a first hearing device (10) including a first control unit (14) and a second hearing device (30) including a second control unit (37) for processing acoustic signals. Each of the hearing devices includes a transceiver (20, 34) for establishing a data communications link (40) between the first and the second hearing devices. At least one of the hearing devices including a sensing means (18, 33) for detecting, whether a telephone handset (19) is placed close to the hearing device. Each of the control units includes at least a first and a second control mode. Both hearing devices are adapted for outputting the processed acoustic signals in the first control mode. Upon detection of the telephone handset the first hearing device is shifted to the second control mode for inhibiting the output of the processed acoustic signals and establishing the data communications link for transmitting the processed acoustic signals to the second hearing device. The second hearing device is also shifted to the second control mode for receiving the processed acoustic signals transmitted from the first hearing device and outputting the transmitted acoustic signals.

24 Claims, 3 Drawing Sheets

HEARING DEVICE, HEARING DEVICE SYSTEM AND METHOD OF CONTROLLING THE HEARING DEVICE SYSTEM

TECHNICAL FIELD

The present invention refers to a hearing device, a hearing device system and a method of controlling the hearing device system, and specifically to a hearing device system including at least two hearing devices for operation in conjunction with the use of a telephone handset.

BACKGROUND ART

A hearing device or hearing aid for an operation in conjunction with a telephone headset to be employed by the user of the hearing aid is known from prior art document US 2006/0013420 A1. This document discloses an arrangement including two hearing aids, one of the hearing aids having means for detecting the presence of a telephone handset close to this hearing aid. Specifically, a sensor is provided for detecting the voice coil of the telephone handset when the handset is held close to the user's ear equipped with the respective hearing aid. When both hearing aids are operated in the normal hearing mode which constitutes a microphone mode for amplifying for the user any noise or sound surrounding the user, and when the particular hearing aid senses the presence of the telephone handset, an automatic switching is performed to an induction receiving mode.

Prior art document US 2005/0175202 A1 discloses a telephone with an integrated hearing aid, wherein both functions are implemented in a single apparatus. When no telephone call is received, the device functions as a normal hearing aid providing the user with amplified sounds of the surrounding sounds. However, when a telephone call is received, the device automatically switches to the function of a telephone and priority is given to the speech information coming from the telephone line. That is, the function of the hearing aid is automatically adapted to receiving and reproducing the telephone call. The function of the hearing aid is not completely switched off, while a telephone call is processed, but the sensing of environmental or surrounding noise is still performed with a higher attenuation. The user can hear both the ongoing telephone call and any noise or sounds surrounding the user.

According to document US 2006/0013420 A1 a switching structure for a hearing aid is known wherein by means of magnetic sensors the presence of a telephone handset is detected. A signal processing circuit of the hearing aid automatically switches the sensitivity to the telephone device (handset) and switches off the acoustic input function. The detection function can be obtained by various and different magnetic sensors.

Prior art document US 2005/0117764 A1 discloses a hearing aid and an operating method for automatically switching to a telephone mode, wherein two hearing aids are considered in view of their levels of the input signals resulting from sounds or noise surrounding the user. The levels of both hearing aids are continuously compared, and when a difference between the levels detected exceeds a predetermined value, then it is assumed that at least in conjunction with one ear of the user, the handset of a telephone system is used, and an automatic switching to the telephone mode is performed. Specifically, at least one of the two hearing devices is switched to the telephone mode.

In general, when a handset of a telephone, whether a cordless telephone according to the DECT standard or a mobile telephone according to the GSM standard or according to some other standard is used, it is possible that when the telephone handset is placed close to the ear of a user wherein a hearing aid is placed and operated, a feedback effect occurs. This undesired feedback produces an unpleasing noise which makes the user feel uncomfortable. In some cases of the prior art mentioned above, the microphone function is completely switched off.

DISCLOSURE OF INVENTION

It is therefore an object of the present invention, to provide a further development of a hearing device, wherein in case of the use of a telephone handset by the user of the hearing device the risk of occurrence of a feedback is minimized or eliminated.

According to the present invention, this object is accomplished by a hearing device, a hearing device system as well as a method of controlling the hearing device system as set out in the following description and in the appended claims.

A Hearing Device

A hearing device according to the present invention comprises a C&P unit for processing picked-up acoustic signals and outputting processed acoustic signals, a transceiver for establishing a data communications link to another hearing device, and a sensing means for detecting whether a telephone handset is placed close to the hearing device. The C&P unit implements at least a first and second control mode, and is adapted for outputting the processed acoustic signals in the first mode, and for switching the hearing device to a second mode when a telephone handset is detected by the sensing unit, and inhibiting or attenuating the output of the processed acoustic signals and establishing a data communications link in the second mode. The term "implementing a first and a second control mode" is taken to mean that the C&P unit is adapted to operate in at least a first or a second control mode. In the following, the C&P unit is represented by a control unit, input and output transducers and possibly a processing unit.

In an aspect of the invention, a hearing device is provided, the hearing device, comprising:

- an input transducer for converting an acoustic input signal to an electric input signal,
- an output transducer for converting a processed electric output signal to an acoustic output signal,
- an electric signal path extending between the input and output transducers,
- a transceiver for establishing a data communications link to another hearing device,
- a sensing unit for detecting whether a telephone handset is placed close to the hearing device, and
- a control unit for controlling at least the acoustic output signal and the transceiver in at least a first and second control mode, wherein

- in the first, normal mode, the control unit is adapted for enabling the acoustic output signal, and
- in the second, Tx-mode, when a telephone handset is detected by the sensing unit, the control unit is adapted for inhibiting or attenuating the acoustic output signal and for enabling the transmission of an electric signal tapped from the signal path to the other hearing device via the data communications link.

In a particular embodiment, the (first) hearing device and the other (second) hearing device form part of a binaural hearing aid system comprising a first hearing device located at a left ear of a user and a second hearing device located at a right ear of a user.

In a particular embodiment, no signal is transmitted via the data communications link, when the hearing device is in its first, normal mode. It is to be understood that the control unit is nevertheless adapted to transmit a signal to change a control mode from one state to the other (e.g. from normal mode to Tx-mode or vice versa), i.e. beginning or ending a period of another control mode.

The term 'placed close to' is taken to mean sufficiently close for the sensing unit to safely detect (the presence of a handset). In an embodiment, 'close to' is defined by less than 0.5 m, such as less than 0.2 m, such as less than 0.1 m, such as less than 5 cm, such as less than 2 cm. The distance is e.g. taken as the relevant distance between the outer enclosures of the hearing device and the telephone hand set when the telephone handset is held in an operable position for its normal use.

In a particular embodiment, the hearing device comprises a manual switch for enabling user control of the shifting between modes of operation (including the first, second and/or third modes of the present invention).

In a particular embodiment, the acoustic output signal in the Tx-control mode is attenuated sufficiently to avoid acoustic feedback. This has the advantage that the wearer of a binaural hearing aid system comprising first and second hearing devices according to the invention can receive an acoustic input from a telephone handset at both ears with a minimal risk of feedback. In a particular embodiment, the acoustic output signal in the Tx-control mode is attenuated with a predefined amount or fraction. In a particular embodiment, the acoustic output signal in the Tx-control mode is inhibited. In this case, the output transducer of the (first) hearing device is silenced, whereby the risk of acoustic feedback is effectively eliminated.

In a particular embodiment, the signal path comprises a processing unit for processing an electric input signal and providing a processed electric output signal. In an embodiment, the processing unit is adapted to provide appropriate values of gain and other parameters of an acoustic signal for a particular user. The signal path may comprise other electronic components than a processing unit. In an embodiment, and A/D converter is included between the input transducer and the processing unit. Likewise a D/A converter may be included between the processing unit and the output transducer. Other components, such a filter bank or a time to time-frequency domain conversion unit or the like for splitting the frequency range in a number of frequency bands can be included.

In a particular embodiment, the control unit in the Tx-mode is adapted for causing the transceiver to transmit the electric input signal to the other hearing device via the data communications link. The electric input signal is the (possibly digitized and/or directionality-improved) signal from the input transducer. This signal has not been adapted to a particular hearing profile by a processing unit. Such processing of the signal can preferably be performed in the other hearing device before its conversion to an acoustic output signal by the output transducer of the (second) other hearing device.

In a particular embodiment, the control unit in the Tx-mode is adapted for causing the transceiver to transmit the processed electric output signal (or a part thereof such as one or more predefined frequency ranges or bands, e.g. the low frequency part of the signal corresponding to the bandwidth of a telephone channel) to the other hearing device (30) via the data communications link. In this case the transmitted signal has been processed and preferably adapted to a user's hearing profile. Such processing of the received signal is thus not needed in the second hearing device.

In a particular embodiment, the hearing device is adapted to provide that the electric signal tapped from the signal path and transmitted to the other hearing device via the data communications link in the Tx-mode is based on a signal originating from the acoustic input signal from a telephone handset. In an embodiment, the control unit is further adapted to be able in this Tx-mode to control the directionality and possible other parameters (e.g. frequency bands considered) to the reception of the acoustic signal from a speaker of a telephone, e.g. a mobile telephone.

In a particular embodiment, the control unit is adapted to automatically enter into the second, Tx-mode when the sensing unit detects the presence of a telephone handset. The sensing of a telephone handset can e.g. be based on a magnetic detection via an inductive coupling between coils of the telephone and the hearing device. An example of the implementation of a sensing unit is e.g. given in US 2006/0013420 A1. Alternatively or additionally, a mode shift can be activated by a manual switch of the hearing device. Further alternatively or additionally, a mode shift can be activated by an electrical or optical or acoustical signal received from another device, such as a remote control or from a telephone apparatus. In a particular embodiment, a mode shift can be activated by an electrical or optical or an acoustical signal received from a telephone apparatus whose call is to be received by the hearing device.

In a particular embodiment, the control unit is adapted to transmit to and receive from the other hearing device via the data communications link instructions for setting the hearing devices. Such settings can e.g. comprise current indications of settings regarding the directionality, noise reduction, feedback, compression, etc. for the transmitting hearing device. In a particular embodiment, the control unit is adapted to set the hearing device and/or the other hearing device in a predefined 'telephone-reception' program mode, where processing parameters are specifically adapted to a signal received from a telephone (including its limited bandwidth), when the sensing unit detects the presence of a telephone handset. This has the advantage that the processed electric output signal transmitted in the Tx-mode can be of limited bandwidth, thereby saving processing power and thus battery power.

In a particular embodiment, the control unit is adapted to transmit to and receive from the other hearing device via the data communications link a Cm-signal identifying the current control mode (e.g. a (second) Tx-mode or a (first) normal mode) of the transmitting hearing device and/or a corresponding appropriate control mode of the other hearing device.

In a particular embodiment, the control unit is adapted to implement a third, Rx-control mode enabling the reception of a signal from the other hearing device via the data communications link and enabling the acoustic output signal including a signal originating from the signal received from the other hearing device. This mode is relevant in case a telephone handset is detected at the other hearing device.

In a particular embodiment, in the third, Rx-mode, the control unit is adapted to enable a mixing of the electric signal received from the other hearing device with an electric signal originating from the input transducer (of the (first) hearing device). In this case, an electric signal originating from an acoustic signal from the environment (and picked up by the input transducer of the (first) hearing device) can be mixed with the electric signal received from the other hearing device (and originating from the speaker of a telephone handset located near the other hearing device) and presented to a user via the output transducer of the (first) hearing device.

In a particular embodiment, in the third, Rx-mode, the control unit is adapted to disable (or inhibit) the electric signal from the input transducer. This ensures that only the electric signal received from the other hearing device (and originating from the speaker of a telephone handset) is presented to a user via the output transducer of the (first) hearing device.

In a particular embodiment, the input transducer comprises at least one microphone, such as one or two microphones, or more than two microphones. In a particular embodiment, directionality information is extracted from the plurality of electric signals generated by the plurality of microphones. In an embodiment, the directionality information is used to detect whether a telephone handset is located close to the hearing device (possibly in connection with the frequency content of the microphone signal).

In a particular embodiment, the data communications link is a wireless radio frequency connection or a wired connection. In a particular embodiment, the wireless data communications link is based on frequencies in the MHz range, e.g. between 1 MHz and 100 MHz. In a particular embodiment, the wireless radio frequency connection is based on an inductive coupling between induction coils located in the hearing device and the other hearing device. In a particular embodiment, the inductive communications link is based on frequencies in the range from 1 MHz to 10 MHz, e.g. between 3 MHz and 5 MHz.

A Hearing Device System

In a further aspect, a hearing device system is provided, the system comprising at least a first hearing device and a second hearing device, each of the hearing devices comprising

- an input transducer for converting an acoustic input signal to an electric input signal,
- an output transducer for converting a processed electric output signal to an acoustic output signal,
- an electric signal path extending between the respective input and output transducers,
- a transceiver for establishing a data communications link between the first and the second hearing devices, and
- a control unit for controlling at least the acoustic output signal and the transceiver in at least a first and second control mode, and at least the first one of the hearing devices including a sensing unit for detecting, whether a telephone handset is placed close to the hearing device, wherein

- each of the control units of the first and second hearing device is adapted for enabling the respective acoustic output signal in the first, normal control mode, and
- the control unit of the first hearing device is adapted in its second, Tx-control mode for inhibiting or attenuating the acoustic output signal and for enabling the transmission of an electric signal tapped from the signal path of the first hearing device to the second hearing device via the data communications link, and
- the control unit of the second hearing device is adapted in its second, Rx-control mode for enabling the reception of a signal from the first hearing device via the data communications link and enabling the acoustic output signal including a signal originating from the signal received from the other hearing device.

It is intended that the features of the hearing device described above, in the detailed description and in the claims can be combined with the hearing aid system described in the present section, in the detailed description and in the claims (and vice versa).

In a particular embodiment, the first and/or the second hearing device is a hearing device as described above under the heading 'A hearing device', in the description or in the claims.

In a particular embodiment, the control unit of the first hearing device is adapted for transmitting via the data communications link instruction signals to the control unit of the second hearing device for setting the second hearing device in its appropriate control mode. Thereby the control mode of the two hearing devices can be controlled from one of the devices, e.g. from the device detecting a telephone handset located near it.

In a particular embodiment, the control unit of the first hearing device is adapted to automatically enter into its second, Tx-control mode, when the sensing unit detects the presence of a telephone handset and to transmit an instruction to the control unit of the second hearing device for setting the second hearing device in its appropriate Rx-control mode, and wherein the control unit of the second hearing device is adapted to receive the instruction and to enter the second hearing device into the second Rx-control mode. Thereby the switching to the second control mode of the first and second hearing device can be controlled from the first hearing device.

The first and second control modes are also termed normal mode and telephone mode, respectively, indicating that the hearing device has its normal function in the first, normal mode, and that the hearing device is adapted to interact with a telephone handset in the second, telephone mode (also termed Tx- and Rx-mode, depending on whether the telephone handset has been detected near the hearing device in question or near the other (opposite) device), respectively.

In an embodiment, where both hearing devices comprises a sensing unit for detecting a telephone located close to it, The control unit is adapted to define the device that first detects a telephone handset at a given instant as the 'master unit'. In an embodiment, the master unit controls the modes of operation of both hearing devices.

In a particular embodiment, the data communications link is a wireless radio frequency connection or a wired connection.

A Method of Controlling a Hearing Device System in Connection with a Telephone Handset In an aspect of the invention, a method of controlling a hearing device system in connection with a telephone handset is provided, the hearing device system comprising at least a first hearing device and a second hearing device, and each of the hearing devices including an input transducer for converting an acoustic input signal to an electric input signal, an output transducer for converting a processed electric output signal to an acoustic output signal, an electric signal path extending between the input and output transducers, a transceiver for establishing a data communications link between the first and the second hearing device, and a control unit for implementing at least a first and a second control mode, and wherein at least the first one of the hearing devices includes a sensing unit adapted to detect, whether a telephone handset is placed close to the hearing device, the method comprising:

- detecting whether a telephone handset is placed close to the first hearing device,
- if a telephone handset is detected, switching the first and second hearing device from a first, normal control mode to a second, Tx- and Rx-control mode, respectively,
- establishing in the second control mode a data communications link between the first and second hearing device,
- transmitting an electric signal derived from the signal path of the first hearing device to the second hearing device via the data communications link, and
- inhibiting or attenuating the acoustic output signal of the first hearing device and enabling the acoustic output signal of the second hearing device, the acoustic output signal including a signal originating from the signal received from the first hearing device.

It is intended that the features (appropriately converted to corresponding process features) of the hearing device and the system described above, in the detailed description and in the claims can (where appropriate) be combined with the method described in the present section, in the detailed description and in the claims (and vice versa).

In a particular embodiment, the electric signal derived from the signal path of the first hearing device and transmitted to the second hearing device during the second, Tx- and Rx-control mode includes a signal originating from the speaker of a telephone handset located at the first hearing device.

In a particular embodiment, the data communications link is based on wireless radio frequency communication, e.g. on inductive coupling between coils located in the first and second hearing devices.

In a particular embodiment, the method further includes the step of transmitting via the data communications link instruction signals from the first hearing device to the second hearing device and/or vice versa.

In a particular embodiment, the control unit of the first hearing device is adapted for transmitting via the data communications link instruction signals to the control unit of the second hearing device for setting the second hearing device in its appropriate control mode.

An advantage of the present invention is to provide a scheme for use of a hearing instrument or a pair of hearing instruments together with a telephone (e.g. a mobile telephone), which is more comfortable since on the one hand the undesired feedback is effectively inhibited and on the other hand no further manual operation or setting is necessary. The performance of the hearing device system according to the present invention therefore provides an increased comfort for the user and an improved handling of the hearing devices while the occurrence of the feedback is suppressed without reducing operability of the system. The interaction between the hearing devices and the telephone handset is improved and facilitated for the user. Hence, it is easy for the user of the hearing device system to wear the hearing devices even when the user receives a telephone call or when a telephone call is intended by the user.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Typically, a hearing device according to the invention is capable of being body worn. In an embodiment, the input transducer and the output transducer are located in the same physical body. In an embodiment, the hearing aid comprises at least two physically separate bodies which are capable of being in communication with each other by wired or wireless transmission (be it acoustic, ultrasonic, electric of optical). In an embodiment, the input transducer is located in a first body and the output transducer is located in a second body. In an embodiment, an input and output transducer are located in a first body and a processing unit in a second body. The term 'two physically separate bodies' is in the present context taken to mean two bodies that have separate physical housings, possibly not mechanically connected or alternatively only connected by one or more guides for acoustical, electric or optical propagation of signals.

First Embodiment

An embodiment of the present invention is described in the following in conjunction with the schematic diagram shown in FIG. 1.

Figure 1:
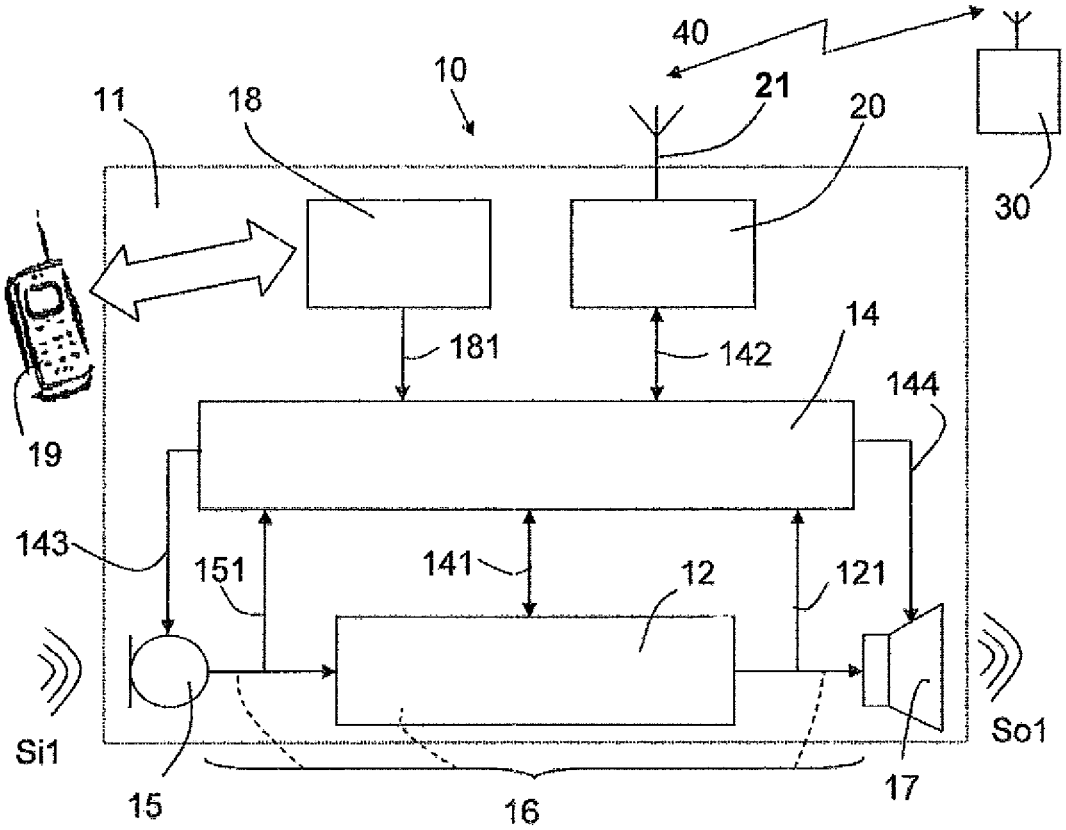
FIG. 1 shows an overall view of a hearing device according to a first embodiment of the present invention.

In more detail, FIG. 1 shows an overall arrangement of a hearing device 10 according to a first embodiment of the present invention. The hearing device 10 comprises a main body 11 wherein the further means and units of the hearing device are arranged or implemented. In other embodiments, the location of the main components of the hearing device may be arranged in other ways, appropriate for fulfilling the actual physical constraints and functional requirements.

In the bottom part of the block diagram, the electric signal path 16 between the electric sides of input transducer 15 and output transducer 17 is illustrated. Acoustic input signal Si1 (possibly originating from the speaker of a mobile telephone 19) is picked up by the microphone 15 and converted to an electric input signal 151, which is fed to a processing unit 12 and to a control unit 14. The processed electric output signal 121 from the processing unit 12 is fed to the control unit 14 and to the receiver 17, which can convert the signal to an acoustic output signal So1. The processing unit 12, which form part of the signal path 16, is typically based on a dedicated processor or a standard microprocessor or microcomputer and includes a central processing unit CPU, interface portions as well as memory means for temporarily or continuously memorizing programs, basic data and further data generated during the operation of the hearing device 10. The processing unit 12 can e.g. pick up information about the environmental sound conditions and can in conjunction with the programs for operating the processing unit 14 and the basic data stored provide an adaptation of the electric input signal to a processed electric output signal, which is adapted to the specific needs (including possibly gain) of a user of the hearing device. Signals 141 (e.g. control signals from the control unit or audio signals tapped from the processing unit) are exchanged between the processing unit 12 and the control unit. A control signal 143 from the control unit 14 to the input transducer 15 is shown. This signal can e.g. be used to enable or disable (inhibit) the electric input of the input transducer, disabling the input, e.g., in case the hearing device 10 is used to 'replay' a telephone signal received at a hearing device 30 located at another ear of the user, thereby avoiding disturbing acoustic inputs from the environment. Similarly, a control signal 144 from the control unit 14 to the output transducer 17 is shown. This signal can e.g. be used to enable or disable (inhibit) the acoustic output So1 of the output transducer 17, disabling the output e.g. in case the hearing device 10 is used to 'replay' a telephone signal received at the hearing device 10 and forwarded to a hearing device 30 located at another ear of the user for being 'replayed' there.

The transducers and the components and connections of the electric signal path provide together the regular function of the hearing device 10, i.e. the picking-up by the input transducer of any surrounding sound or noise in the form of acoustic signals Si1 and the amplification of corresponding signals in a suitable manner to be fed by the output transducer 17 into the user's ear canal and ear drum. Additionally, a feedback reduction system is typically implemented to reduce or eliminate acoustic feedback from the output to the input transducer (under 'normal' conditions). Such system is not shown, because in the presence of a telephone handset close to a hearing device providing a large gain, special care has to be taken to avoid howl even when a feedback cancellation system is implemented. A scheme for handling such situation is the subject of the present application.

For a hearing device with a mould located in the ear canal, a venting channel is typically implemented to reduce the occlusion effect in the user's ear canal which is caused by a build up of low frequency sound pressure based on sound being transmitted through the jaw bone (own speechichewing noises). This undesired phenomenon, which results in an uncomfortable feeling for the user of the hearing device can, to a large extent, be suppressed by the venting channel. Higher frequency components of sound are able to run through the venting channel in the direction to the outside of the hearing device, and a large venting channel having a greater cross-sectional area will allow a broader spectrum of sound to escape through it. Ideally, a vent should provided in such a form that it would simultaneously permit low frequency sound to leave the ear canal at the certain time, but also to prevent higher frequencies (2 to 6 kHz) sound from exciting the ear canal and causing feedback which is very uncomfortable for the user of the hearing device.

Problems with acoustic feedback in the event of telephone handset being located near the ear of a wearer of a hearing device are, however, present also for other types of hearing devices without a mould.

Referring back to the arrangement shown in FIG. 1, the hearing device 10 further comprises a sensing unit in the form of sensor 18 which is adapted for sensing, whether a handset 19 of any kind of telephone is located close to this particular hearing device 10 (when the hearing device 10 is located in or provided at the user's ear canal and being in an operational condition, such as turned on). A signal 181 indicative of the detection of a handset is fed from the sensor unit 18 to the control unit 14. An example of the implementation of a sensing unit is e.g. given in US 2006/0013420 A1, where a sensor for sensing magnetic fields is described. The magnetic field can e.g. be generated by a permanent magnet or an induction coil present in a telephone handset.

During operation, when the user of the hearing device 10 intends to have a telephone call or when a telephone call from an external terminal is received, then the user for listening to the information presented by the loudspeaker of the telephone places the handset 19 thereof close to one of his ears and, thus, close to one of the hearing devices 10 worn by the user.

The hearing device 10 further comprises a transceiver 20, which is adapted for data communication with another corresponding transceiver of any other corresponding hearing device 30. The transceiver 20 combines and shares to a certain extent common circuitry of a transmitter and a receiver for both receiving from another transceiver or transmitting to the other transceiver any data upon establishing a corresponding data communications link. To this end, the transceiver is connected to an antenna 21 by means of which, in case of a wireless data communications link 40, connection can be made between two or more transceivers of other corresponding hearing devices. Signals 142 can be exchanged between transceiver 20 and control unit 14. Transmitted signals 142 can e.g. include the electric signal from the signal path 16 to be transmitted to the other hearing device via communications link 40 (e.g. (unprocessed) electric input signal 151 or processed electric output signal 121 from the processing unit 12 or a signal tapped there between, cf. e.g. signal 141). Transmitted signals 142 can further include instruction signals indicative of the control mode of the hearing device 10 and/or other 'state'-information of the hearing device. Received signals 142 can typically include equivalent information received form the other hearing device 30.

The control unit 14 for controlling the modes of operation of the hearing device 10 can be implemented as part of a processing unit, requiring mainly logic operations. In the present embodiment, the control unit can enable and disable the microphone 15 (signal 143), the receiver 17 (signal 144), influence the processing unit 12 (signals 141), control the signals transmitted to the other hearing device via transceiver 20 and data communications link 40 (signals 142). Basis for the decisions is at least input signal 181 from sensing unit 18 indicative of a telephone handset being close to the hearing device. Further, Cm-input signals from the other hearing device, e.g. indicating the current control mode of the other hearing device and received via transceiver 20, can be used (signals 142). The following modes of operation are typically envisaged for a given hearing device (cf. also FIG. 3 and the corresponding description):

| | |
|---|---|
| Normal mode | No telephone handset present at either hearing devices. Normal signal path from input to output transducer |
| Tx-mode | (receive signal from sensing unit) Telephone handset present at this device. (possibly transmit Cm-signal to other device) Transmit audio signal to other device, disable acoustic output of audio signal. Enable acoustic input |
| Rx-mode | Telephone handset present at other (opposite) hearing device. (possibly receive Cm-signal from other device) Receive audio signal from other device, enable acoustic output of audio signal (possibly disable acoustic input) |

The circuitry described above in conjunction with the schematic view of FIG. 1 and forming part of the hearing device 10 is typically powered by a battery power source, which is preferably provided in the form of any removable or in specific cases rechargeable battery.

The representation in FIG. 1 does not show the real proportions of the hearing device 10 according to the present invention, but only provides a schematic diagram to support understanding of the present invention. In particular, the hearing device described in conjunction with the presentation of FIG. 1 is provided for insertion into the human ear, that is, into the user's ear canal (type: CIC, ITC, ITE) or can be arranged outside the user's ear canal wherein the main body 11 of the hearing device 10 is arranged behind the ear (type: BTE) which results in an arrangement which is suitable for any kind of hearing loss of the user, and the hearing device 10 can be provided with less restrictions in view of dimensions and size. Usually, the hearing device is housed within a curved shell which is located behind each ear of the user and delivers sound through a clear tube which is very inconspicuous. The clear tube sits into a mould that has been customized to comfortably fit inside each ear. Basically the same applies for the in-the-ear-hearing devices (ITE) wherein the hearing device is housed within a custom-made shell which fits comfortably inside each ear and delivers sound directly into the ear.

When ITC (in-the-canal) hearing devices are used, such hearing devices can hardly be seen and are very easy to operate. The hearing device is specifically housed within a custom-made shell which fits comfortably inside the ear canal and delivers sound directly to the ear. The CIC hearing device (completely-in-the-canal) is virtually invisible to any other people. The hearing device is completely housed in a tiny shell which fits comfortably and completely into the ear canal. The device can be removed from the ear canal by pulling a tiny cord.

Second Embodiment

The operation of the hearing device 10 as described in conjunction with the first embodiment as well as the interaction of plural hearing devices 10 forming a hearing device system as well as the control concept thereof is described in the following in conjunction with a second embodiment of the present invention. Regarding the second embodiment of the present invention, reference is made to FIGS. 2 and 3.

Figure 2:
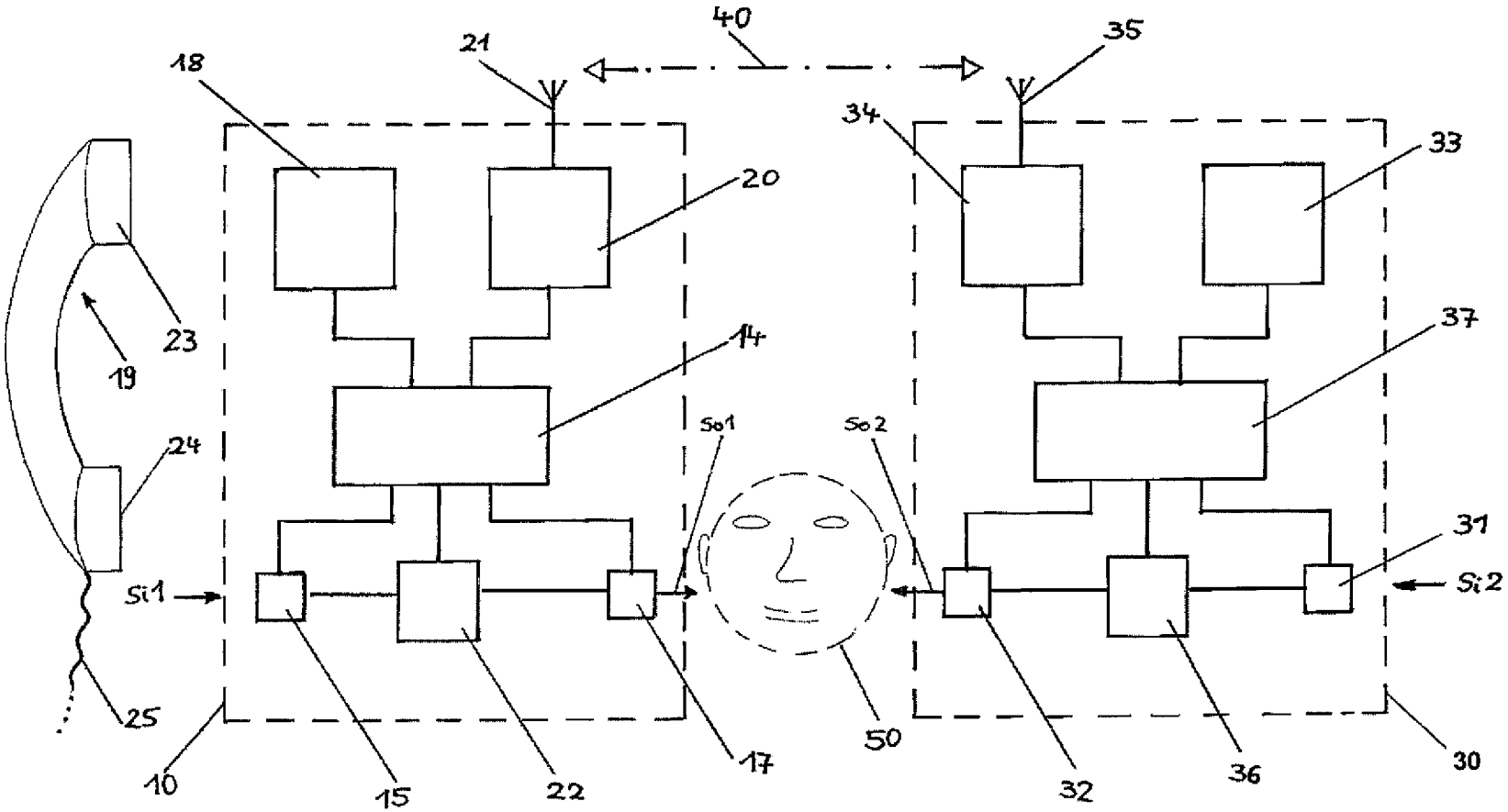
FIG. 2 shows a schematic view of a hearing device system comprising two hearing devices.

FIG. 2 schematically shows the arrangement of a hearing device system, which is composed of at least first and second hearing devices 10, 30 arranged in the manner as described in conjunction with the first embodiment of the present invention. The interaction between these at least two hearing devices 10 and 30 forming the hearing device system as well as the cooperation with the telephone handset 19 as shown in FIG. 2 is described in the following.

As is roughly shown in FIG. 2, both the first hearing device 10 and the second hearing device 30 are arranged at the ears or in the ears of a user 50.

The first and second hearing devices 10 and 30 may establish a communication between each other by means of the first transceiver 20 and the second transceiver 35 of the hearing devices 10 and 30 in conjunction with the respective associated antennas 21 and 35, resulting in a data communications link 40 being established as shown in FIG. 2 by a dot and dash arrowed line. That is, under control of the first and second control units 14 and 37, each of the first and second hearing devices 10 and 30 may initiate the establishment of the data communications link 40 between them for transmitting data, instruction signals and/or any kind of information in a wireless manner by using radio frequency (RF) transmission.

When the first and second hearing devices 10 and 30 are inserted into the ears of the user 50 or are arranged at the user's ears, and when the hearing devices 10 and 30 are switched on for normal operation, the regular function of the hearing devices is performed, which results in picking up any sound or noise Si1 (first hearing device 10) or Si2 (second hearing device 30, FIG. 2) surrounding the user and feeding the user's ear canal with an amplified sound (acoustic output signals) So1 (first hearing device 10) or So2 (second hearing device 30, FIG. 2) to compensate for the user's hearing loss. Accordingly, both hearing devices 10 and 30 constituting the hearing device system are set initially in view of amplification (gain) and operate independently from each other and simultaneously in the normal mode, which is the first mode (regular hearing device mode), that is, each of the hearing devices 10 and 30 outputs or reproduces the acoustic signals Si1 and Si2 (respectively picked up by the corresponding input transducer 15 and 31) in the form of the output signals (processed acoustic signals) So1 and So2, respectively.

The basic setting of the hearing devices 10 and 30 for an operation in the normal mode in addition allows the user to provide a user individual setting which may be varied by the user 50. The basic setting is stored in the control units 14 and 37, and modification can be carried out by the user 50 according to predetermined measures to provide the individual setting, preferably an individual setting of each particular hearing device 10 or 30. This setting forms the precondition for the regular operation as a hearing device which constitutes the normal (control) mode or first control mode.

As is in detail described above, both hearing devices 10 and 20 which are structured and equipped in basically the same manner, include a telephone sensor 18 or 33 for sensing the presence or absence of the telephone handset 19 placed in the vicinity of one of the user's ears (hearing devices). Such a situation is shown in FIG. 2. As an example and for purposes of the following explanations it is assumed that the telephone handset 19 is placed close to the user's first hearing device 10. That is, the user 50 may have received a telephone call or intends to make a telephone call and therefore places the telephone handset 19 close to his ear being equipped with the first hearing device 10 (FIG. 2).

As can be seen from FIG. 2, the telephone handset 19 includes a speaker 23 which is located close to the first hearing device 10, and more specifically close to the sensor 18 (sensing means, telephone sensor) for sensing that the telephone handset 19 is close to the first hearing device 10. The telephone handset 19 also comprises a microphone 24 as well as a wired connection 25 to the telephone device (not shown). Instead of the wired connection, the telephone handset 19 may also be a cordless telephone handset (e.g. according to the DECT standard), or a mobile phone (cellular phone), so that the wired connection in the form of a cord 25 can be omitted.

When the telephone handset 19 is placed close to the user's ear and, thus, close to the first hearing device 10, the sensor 18 of the first hearing device 10 (the example shown in FIG. 2) senses the presence of the telephone handset 19 and generates a detection signal (181 in FIG. 1) reflecting the detection result and transmits this detection signal to the control unit 14 for further data evaluation and for setting specific control conditions.

The sensor 18 of the first hearing device 10 and in a similar manner the sensor 33 of the second hearing device 30 (when the user 50 places the telephone handset 19 to his other ear) may provide a detection in view of a time varying magnetic field occurring in the speaker 23 of the telephone handset 19. According to another development, the sensor 18 as well as the sensor 33 of the first and second hearing devices 10 and 30 may also be provided in the form of any proximity sensor for reliably detecting that the telephone handset 19 is placed close to the particular hearing device, such as the first hearing device 10 according to FIG. 2, or may be provided in the form of any other suitable sensor means for obtaining the necessary detection result.

When a particular one of the hearing devices such as the first hearing device 10 (FIG. 2) detects the presence of the telephone handset 19 placed close to the respective hearing device 10 (based on detection signals from sensor 18), specifically the first hearing device 10 can be considered to represent the active hearing device since this (first) hearing device has detected the presence of the telephone handset 19.

Based on the information of the presence of the telephone handset 19 and of a probably incoming or outgoing telephone call, the present first (active) hearing device 10 provides an automatic switching to a second mode of operation (second control mode) which is a telephone mode. That is, the active one of the hearing devices 10 and 30 having detected the presence of the telephone handset 19 quits the normal operation mode which is a regular operation mode (first control mode) of the hearing device and enters into the second control mode. This switching is carried out automatically upon detection of the presence of the telephone handset 19 close to the user's ear.

In this telephone mode (second control mode) the control unit 14 of the first hearing device (active hearing device) 10 drives the transceiver 20 to initiate and establish the data communications link 40 between both hearing devices 10 and 30. To this end, the transceiver 20 of the first hearing device 10 is activated and sends via the antenna 21 a radio frequency signal (RF signal) to the second hearing device 30 which can be picked up by the antenna 35 and the transceiver 34 of the second hearing device 30.

In a similar manner as in the first hearing device, the control unit 37 thereof drives the transceiver 34 for supporting and finally establishing the wireless data communications link 40. When the data communications link 40 is established, the transceivers 20 and 34 are able to establish a suitable and reliable continuous wireless data communication between the first and the second hearing devices 10 and 30.

The wireless communication via the data communications link 40 may be based on a selectable data channel and may be performed according to a predetermined protocol and according to a basic setting of each of the hearing devices 10 and 30 of the hearing device system. In particular, when the data communications link 40 is established, both hearing devices 10 and 30 may exchange actual data, new setting instructions such as the switching from the normal mode (first control mode) to the telephone mode (second control mode), and further corresponding or necessary settings and control parameters.

In the present case, the first hearing device 10 which is the active hearing device informs the second hearing device 30 which is a passive hearing device that the sensor 18 of the first hearing device 10 has detected the presence of the telephone handset 19 and that an automatic switching from the normal mode of the hearing devices 10 and 30 to the telephone mode is necessary. This switching is then carried out automatically in both hearing devices 10 and 30 concerned, and both hearing devices may confirm to the other that the automatic switching to the telephone mode which is the second control mode has been performed and is completed. That is, both hearing devices 10 and 30 involved have entered into the telephone mode and the specific operation thereof.

Specifically, in the telephone mode a continuous wireless data communications link 40 is established, resulting in a continuous transmission and reception of radio frequency signals (RF signals) by the respective transceiver 20 and 34 via the corresponding antenna 21 and 35 (FIG. 2). The data communications link 40 may have the above-mentioned safe protocol, and may be based on a selectable, variable or initially settable communication channel. At the beginning of the operation of the telephone mode (second control mode) the hearing device system including at least the first and second hearing devices 10 and 30 automatically configures itself in view of the data communications link 40 and for receiving and transmitting data, instructions, and mainly the information (data) reproduced by the speaker 23 of the telephone handset 19 which is picked up by the input transducer 15 (probably provided in the form of a microphone) of the first hearing device 10.

The hearing device system stands under the combined control of both control units 14 and 37, wherein the control unit 14 of the first hearing device 10 close to which the presence of the telephone handset 19 has been detected, forms the master (active) hearing device, and the second hearing device 20 forms the slave hearing device as this second hearing device is instructed and to a certain extent configured for data communication from the first hearing device 10 in view of the telephone mode.

When both hearing devices 10 and 30 of the hearing device system have entered into the telephone mode (second control mode) only the input transducer 15 (microphone) of the first hearing device 10 is active, whereas the output transducer 17 thereof (probably provided in the form of a specific speaker) is switched off. That is, the first hearing device 10 does no longer operate as a normal hearing device but only functions for receiving from the telephone handset 19 by means of the input transducer 15 the Information sound or information signals which are then fed to the control unit 14 and are evaluated to provide an information structure or data suitable for radio frequency transmission via the transceiver 20 and the antenna 21 to the antenna 35 and the transceiver 34 of the second hearing device 30.

When the data communications link 40 (based on RF signals) has been established and the formal aspects for configuring both hearing devices 10 and 20 are completed, the radio-frequency-based data communications link 40 is continuously maintained and the information signals from the telephone handset 19 are transmitted from the first hearing device 10 to the second hearing device 30. Hence, the information signals received from the telephone handset 19 and picked up by the input transducer 15 of the first hearing device 10 are without reproduction by the first hearing device 10 transmitted by means of the wireless data communications link to the second hearing device 30 for reproduction.

The reproduction of the information signals provided by the telephone handset 19 is carried out in the second hearing device 30, and specifically the information received via the antenna 35 and the transceiver 34 based on the wireless data communications link 40 is supplied to the control unit 37 of the second hearing device 30, and this information is evaluated and processed to obtain information signals suitable for reproduction by the output transducer 32 of the second hearing device 30 (the output transducer 32 usually being provided in the form of a specific speaker). The output transducer 32 of the second hearing device 30 therefore reproduces the transmitted signals and/or data and outputs signals So2 (FIG. 2).

The information provided by the telephone handset 19 and picked up by the first hearing device 10 is evaluated in the first hearing device 10 only to obtain a structure of data or information suitable for transmission of this information via the data communications link 40 (RF communication), whereas the reproduction of the information provided by the telephone handset 19 is processed for the user 50 (reproduction) in the second hearing device 30 which is remote from the telephone handset 19. Reproduction of the sound information from the telephone handset 19 by the first hearing device 10 is inhibited.

The setting of the hearing device system, i.e. the self-configuration of the hearing device system upon establishing the data communications link 40 between the first and second hearing devices 10 and 30 makes it possible that each of the hearing devices 10 or 30 provides its own respective function necessary according to the telephone mode (second control mode) into which both hearing devices 10 and 30 have entered upon detection of the telephone handset 19 close to an ear of the user 50. The first hearing device 10 functions as a transmission means (direct reproduction inhibited) for transmitting the information (sound information, data signals)

from the telephone handset 19 to the other side of the user's head and, thus, to the second hearing device 30 located in or close to the other ear of the user 50. That is, the reproduction of the information provided by the telephone handset 19 is reproduced by the second hearing device (slave hearing device) 30 located remote from the telephone handset 19 and not being adjacent (i.e. not located close to) the telephone handset 19.

The control concept as mentioned above is carried out automatically so that the user does not need to set or instruct the hearing device system that a telephone call is intended or received. In more detail, the sensors (sensing means, telephone sensor) 18 of the first hearing device 10 and the sensor 33 of the second hearing device 30 continuously and automatically monitor whether any telephone handset (irrespective of a wireless or wired telephone handset or any kind of telephone) is placed close to one of the hearing devices 10 or 30 of the hearing device system, and when one of these hearing devices automatically detects the presence of the telephone handset close to this hearing device, an automatic cancelling of the normal operation mode (normal mode, first control mode) is performed and the hearing device system automatically switches to and enters into the telephone mode (second control mode) having the above-described control concept of using the active (first) hearing device 10 as a transmission device, and using the second hearing device 30 remote from the telephone handset 19 as a reproduction device.

Figure 3:
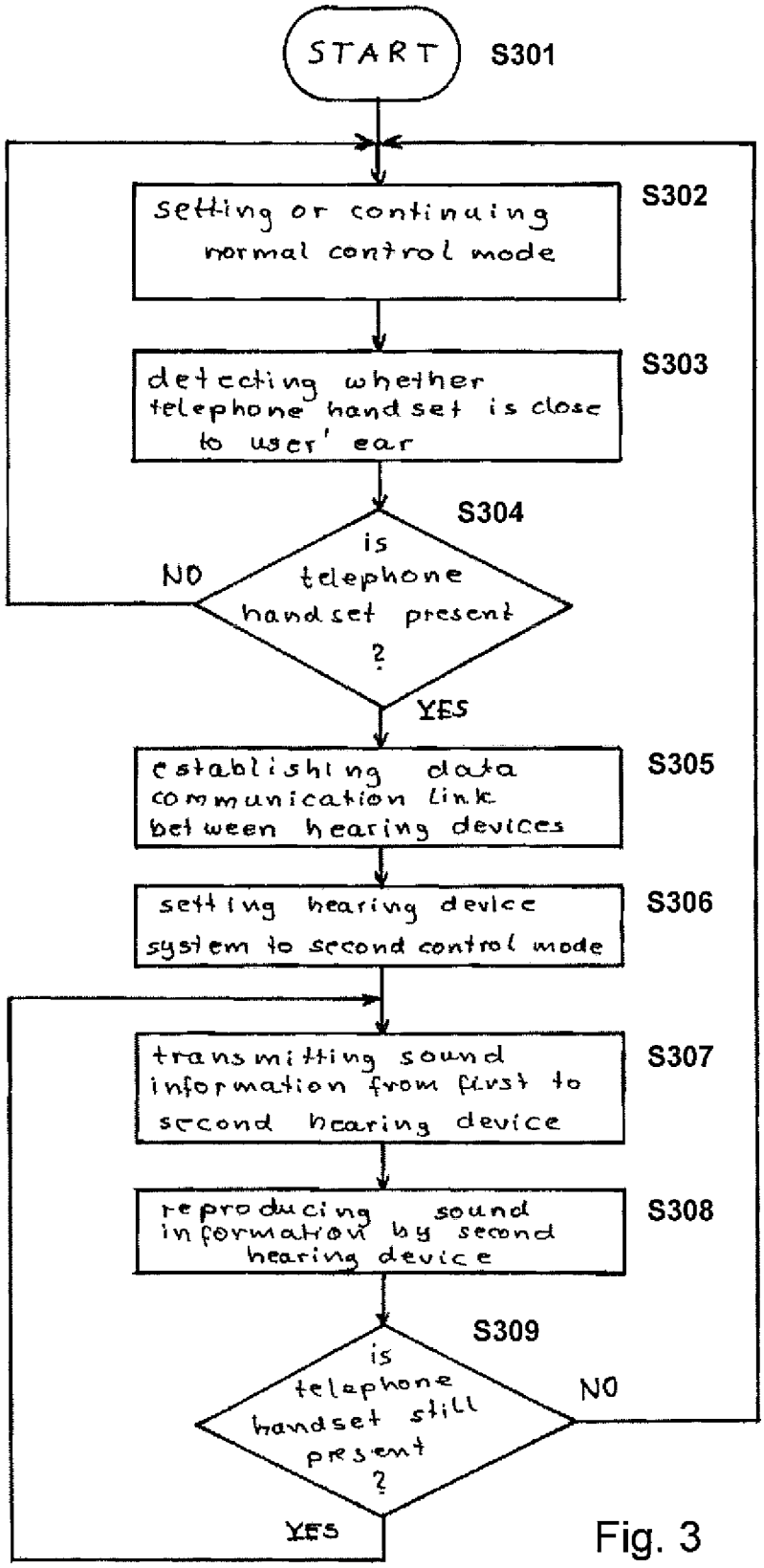
FIG. 3 is a flowchart representing steps of a control concept for controlling the hearing device system.

Regarding this control concept, the corresponding steps for carrying out the specific control of switching from the normal mode (first control mode) to the telephone mode (second control mode) and the specific requirements in the telephone mode are shown in FIG. 3.

According to FIG. 3, step S301 is a general start of the process.

In case no setting for other purposes is provided and the telephone handset 19 is not detected by any one of the hearing devices 10 and 20 of the hearing device system, the hearing device system performs as a default process the normal control mode. Step S302 therefore refers to the setting or continuing (maintaining) of the normal control mode and the performance of the normal operation (which is a default operation) as a regular hearing device to cope with user's hearing loss.

Since the control concept provides automatically-processed steps and measures, step S303 refers to the (cyclical) detection of whether the telephone handset 19 is placed near or close to the user's ear. This detection is made in an automatic manner and cyclically every predetermined period of time, i.e. for example every second or according to any suitable longer or shorter predetermined period of time.

Thereafter, step S304 refers to the decision whether the detection actually reveals that any telephone handset such as the telephone handset 19 is present, indicating that the telephone handset 19 is located close to the user's ear. In case the detection result is NO then the process returns back to step S302 to continuously perform the normal operation according to the normal (first) control mode.

However, if in step S304 a decision is made that the telephone handset 19 is located close to the user's ear, and in particular close to the first hearing device 10 as is shown in FIG. 2, the answer is YES, and the process proceeds further to step S305.

In step S305 the active hearing device, in the present case the first hearing device 10 having detected the presence of the telephone handset 19 has performed the switching of its own system to the telephone mode (second control mode) and now tries to establish the data communications link 40 between the hearing devices involved.

When the data communications link 40 is established and a stable data communication has been achieved, the process proceeds further to step S306 wherein the setting of the complete hearing device system (both the first and the second hearing device 10 and 30) into the telephone mode is performed. That is, when step S306 is completed, both hearing devices 10 and 30 of the hearing device system are shifted or switched to the telephone mode (second control mode).

When the telephone mode is established and the data communications link 40 is stable and reliable, the process according to a further step S307 transmits the sound information from the hearing device (first hearing device 10 in the example shown in FIG. 2) near the telephone handset 19 to the other (second) hearing device 30. In more detail, the first hearing device 10 (master hearing device) continuously transmits the picked-up information provided by the telephone handset 19 (sound signals) to the second (the other, the remote) hearing device 30. Direct reproduction of the sound information from the telephone handset 19 by the first hearing device 10 is inhibited.

In the second hearing device (the slave hearing device) 30 as shown in FIG. 2 reproduction of the information is performed. That is, the information signals of the telephone handset 19 are reproduced by the remote (the other) hearing device 30. This is represented by step 308 in FIG. 3.

In order to cope with the case that after some time the telephone call is terminated and the user 50 moves the telephone handset 19 away from his ear and, thus, away from the first (active, master) hearing device 10, in conjunction with the cyclical detection of the presence of the telephone handset 19, it is also cyclically based on a predetermined period of time detected whether the telephone handset 19 is still present. In case the answer of this determination in step S309 is NO, the flow of the process shown in FIG. 3 proceeds from step S309 to step S302, the wireless transmission and reproduction of the information from the first hearing device 10 is cancelled or ended, and the hearing device system again automatically switches back to the normal mode (first control mode) for operation of the hearing device system as normal hearing devices. In case the answer to the question in S309 is YES the transmission and reproduction is continued, as represented in FIG. 3 by arrow back to step 307.

The control concept according to the present invention and as shown in FIG. 3 therefore provides a continuous monitoring of whether the telephone handset 19 is held close to the user's ear. Depending upon the action by the user, that is, depending upon whether the user moves the telephone handset 19 to his ear or moves the telephone handset 19 away from the ear, this is detected by the respective hearing device 10 concerned, and in any cases an automatic switching to the suitable corresponding operation or control mode is performed. The detection of the telephone handset 19 close to the user's ear results in an automatic switching or shifting from the normal mode to the telephone mode, and when it is detected that the telephone handset 19 is again moved away from the user's ear, an automatic switching back to the normal operation mode (first control mode) is performed.

Modifications of Embodiments

The embodiments of the hearing device, the hearing device system and the control method thereof according to the present invention as described above may be modified in the manner described in the following.

The hearing device system according to the present invention and as described above provides a data communication on the basis of the data communications link 40 which is preferably a wireless data communications link being established between both the first and the second hearing device 10 and 30. In an alternative development of the present invention the wireless communication can be replaced at least temporarily by a data communications link based on a cord or wire, thereby reducing the risk of problems in conjunction with further electro-magnetic devices, specifically when the hearing device system is operated in proximity to a strong magnetic AC field. The wired data communications link is appropriate basically when the hearing devices 10 and 30 are provided behind the ear or in the ear.

In the above embodiments, reproduction of the sound information from the telephone handset 19 by the first hearing device 10 is inhibited. However, according to a further modification, the reproduction of the information provided by the telephone handset 19 may also be carried out in the first (master, active) hearing device 10, but in this case, in order to still effectively inhibit the undesired effect of feedback the reproduction of the telephone handset sound information is carried out with a considerably reduced amplification or gain. That is, in order to at least slightly increase the intelligibility of the speech information provided by the telephone handset 19, reproduction of this information is performed in the first (active, master) hearing device 10 with a higher predetermined attenuation. This is referred to in FIG. 2 with an arrow having reference number So2. Hence, in order to reduce the effect of having sound entry only in one ear (the opposing ear equipped with the second passive slave hearing device), an attenuated (damped) reproduction of the telephone information is specifically controlled by the control unit 14 of the first hearing device 10 and is fed to the user's ear. This represents a modified second control mode of the first hearing device or can be considered as a third control mode thereof.

The attenuation in the above third control mode (which is also a telephone mode) can be performed according to a predetermined level, which considerably reduces the danger of causing undesired feedback in this (third) telephone mode. This will be recognized by the user 50 of the hearing device system similar to the adjustment of the balance control of a stereo music equipment.

Regarding the function of the second (slave) hearing device 30, this hearing device 30 still performs the main reproduction of the sound information provided by the telephone handset 19.

Moreover, according to a further development or modification, in the telephone mode, the second (slave) hearing device 30 may in addition to the reproduction of the telephone information sense and evaluate the incoming surrounding sound Si2 around the user to obtain a control of dynamically amplifying in a controlled manner (i.e. a limited manner) the surrounding noise or sound Si2 to achieve a suitable mixture of both the telephone information coming via the wireless (or wired) data communications link 40, and the picked-up surrounding noise or sound. In this connection, the attenuation of the sound signals corresponding to the picked-up surrounding noise or sound Si2 may be adjustable by the user manually or beforehand.

According to a further modification the setting of the hearing device system according to the present invention and in particular user-related settings or modifications can be carried out by using a remote control (not shown in the figures) instead of a manual setting by means of input elements located at the hearing device. More specifically, since both hearing devices are provided with the possibility of establishing the wireless or wired data communications link 40 (transceivers 20 and 34 each equipped with an antenna 21 and 35, respectively) these devices in conjunction with a control by the control units 14 and 37 can be used for providing a setting of both the first and second hearing devices 10 and 30 by means of a remote control (not shown in the figures), which can be operated in a suitable manner by the user 50. Hence, the data communications link 40 can be provided between each of the hearing devices 10 and 30 and the remote control, and specifically user-related settings or modifications of settings can be carried out without removing the hearing device (s) in question from the user's ear(s).

The remote control may also serve for manually switching (in specific cases) from the normal mode to the telephone mode or from the telephone mode back to the normal mode depending upon the user's intention. Any kind of presetting of both hearing devices 10 and 30 can be carried out by means of the remote control and the data communications links established there between.

The hearing devices 10 and 30 forming part of the hearing device system may cyclically provide a setting or balancing of the settings of both hearing devices 10 and 30 or may exchange general information automatically or on request by a user input by means of the remote control (not shown).

Such balancing setting of both hearing devices 10 and 30 may also be based on actual changes in the hearing loss of the user, thereby providing the possibility of and easy modification of the basic settings of the hearing device system.

In the hearing devices 10 and 30 of the hearing device system both hearing devices are equipped with a sensor (telephone sensor, sensing means) for sensing whether the telephone handset 19 is close to or adjacent the user's ear which is equipped with one of the hearing devices 10 and 30. When the user 50 of the hearing device system according to the present invention agrees to always place the telephone handset 19 when being involved in a telephone call close to one and the same ear, then the respective hearing device associated with the other ear may be arranged or structured such that the sensor (for example sensor 33 of the second hearing device 30) may be omitted. This would reduce costs and the size of the circuitry of the hearing device in question while maintaining the improved functioning and handling of the hearing device system according to the present invention.

It is also possible to obtain a setting of plural hearing devices (more than two hearing devices) so that the picked-up sound information from the telephone handset 19 can be transmitted not only to the other hearing device (such as the second hearing device 30 in the present case) of the user but to any further suitable hearing device of a person positioned close to the user involved in the telephone call. Such a further hearing device must have a corresponding hardware (structure) and setting (programming) to obtain a reliable data communications link.

As is already mentioned above, also the structure and arrangement of the hearing device system according to the present invention and specifically according to the above modifications provide the advantages as can be achieved with the first and second embodiment as described. The main advantage is in general that acoustic feedback will not occur when the input transducer 15 which is located in a particular hearing device (such as the first hearing device 10) is used on the one side (the side of the telephone handset 19) and the reproduction is carried out on the other side of the head, i.e. is carried out in the other opposite (second) hearing device 30. The user must only get used to the sound coming from the opposite side when the telephone handset 19 is used, but usually this will not provide any problems. This particular problem can be reduced when in a considerably attenuated manner the telephone information from the telephone handset 19 is also reproduced in the hearing device 10 on the side of the telephone handset 19, as is described above. Inhibition of the unwanted effect of feedback is ensured.

It is further to be noted that the Figures described above do not represent real proportions but only provide a schematic view helpful for understanding of the subject matter of the present invention. Moreover, the present invention has been illustrated and described in detail by means of the foregoing description in conjunction with the drawings, and such illustrations and descriptions are to be considered illustrative or exemplary and not restrictive.

The present invention is not limited to the embodiments as described above, and even reference numbers shown in the drawings and referred to in the description and the claims do not limit the scope of the present invention. It is considered that all technical means and equivalent elements or components are included in the present invention and are considered to form part of the scope of the present invention as defined by the appended claims.

The invention claimed is:

1. A hearing device, comprising:

a microphone for converting an acoustic input signal to an electric input signal, an output transducer for converting a processed electric output signal to an acoustic output signal, an electric signal path extending between the microphone and the output transducer, a transceiver for establishing a data communications link to another hearing device, a sensing unit for detecting whether a telephone handset is placed close to the hearing device, and a control unit for controlling at least the output transducer, the acoustic output signal, and the transceiver in at least a first control mode and a second control mode, wherein in the first control mode, the control unit is configured to control the output transducer to output the acoustic output signal originating from the microphone, and in the second control mode, Tx-mode, when the telephone handset is detected by the sensing unit, the control unit is configured to control the output transducer to inhibit or attenuate the acoustic output signal that is output by the output transducer and further configured to control the transceiver to transmit an electric signal originating from the microphone and tapped from the signal path to the other hearing device via the data communications link.

2. A hearing device according to claim 1, wherein the signal path comprises a processing unit configured to process the electric input signal and to provide the processed electric output signal.

3. A hearing device according to claim 1, wherein the control unit in the Tx-mode is adapted for causing the transceiver to transmit the electric input signal to the other hearing device via the data communications link.

4. A hearing device according to claim 1, wherein the control unit in the Tx-mode is adapted for causing the transceiver to transmit the processed electric output signal to the other hearing device via the data communications link.

5. A hearing device according to claim 1 adapted to provide that the electric signal tapped from the signal path and transmitted to the other hearing device via the data communications link in the Tx-mode is based on a signal originating from the acoustic input signal from the telephone handset.

6. A hearing device according to claim 1, wherein the control unit is adapted to automatically enter into the Tx-mode when the sensing unit detects the presence of the telephone handset.

7. A hearing device according to claim 1 wherein the control unit is adapted to transmit to and receive from the other hearing device via the data communications link instructions for setting the hearing devices.

8. A hearing device according to claim 1 wherein a Cm-signal identifying the current control mode of the hearing device and/or a corresponding appropriate control mode of the other hearing device is transmitted to the other hearing device.

9. A hearing device according to claim 1, wherein the control unit is configured to implement a third control mode, Rx-control mode, in the Rx-control mode the control unit is configured to control the transceiver to receive a second signal from the other hearing device via the data communications link and further configured to control the output transducer to output the acoustic output signal including a second acoustic signal originating from the second signal received from the other hearing device.

10. A hearing device according to claim 9, wherein in the Rx-control mode the control unit is configured to control mixing of the second signal received from the other hearing device with a signal tapped from the signal path, originating from the microphone.

11. A hearing device according to claim 9, wherein in the Rx-control mode the control unit is configured to inhibit or attenuate the electric input signal from the microphone.

12. A hearing device according to claim 1 wherein the data communications link is a wireless radio frequency connection or a wired connection.

13. A hearing device according to claim 12 wherein the wireless radio frequency connection is based on an inductive coupling between induction coils located in the hearing device and the other hearing device.

14. A hearing device system, comprising:

at least a first hearing device and a second hearing device, each of the hearing devices comprising a microphone for converting an acoustic input signal to an electric input signal, an output transducer for converting a processed electric output signal to an acoustic output signal, an electric signal path extending between the microphone and the output transducer, a transceiver for establishing a data communications link between the first and the second hearing devices, and a control unit for controlling at least the output transducer, the acoustic output signal and the transceiver in at least a first control mode and a second control mode, and at least the first hearing device includes a sensing unit for detecting whether a telephone handset is placed close to the first hearing device, wherein each of the control units of the first and second hearing device is configured to control the output transducer of the respective hearing device to output the acoustic output signal originating from the microphone in the first control mode, and the control unit of the first hearing device is configured to control the output transducer of the first hearing device to inhibit or attenuate the acoustic output signal that is output by the output transducer and further configured to control the transceiver of the first hearing device to transmit an electric signal originating from the microphone and tapped from its signal path to the second hearing device via the data communications link in its second control mode, Tx-control mode, and the control unit of the second hearing device, in its second control mode, Rx-control mode, is configured to control the transceiver of the second hearing device to receive a signal from the first hearing device via the data communications link and further configured to control the output transducer of the second hearing device to output the acoustic output signal including an acoustic signal originating from the signal received from the first hearing device.

15. A hearing device system according to claim 14 wherein the control unit of the first hearing device is adapted for transmitting via the data communications link instruction signals to the control unit of the second hearing device for setting the second hearing device in its appropriate control mode.

16. A hearing device system according to claim 14, wherein the control unit of the first hearing device is configured to automatically enter into its second control mode, the Tx-control mode, when the sensing unit detects the presence of the telephone handset and to transmit an instruction to the control unit of the second hearing device for setting the second hearing device in its Rx-control mode, and the control unit of the second hearing device is configured to receive the instruction and to enter the second hearing device into its second control mode, the Rx-control mode.

17. A hearing device system according to claim 14 wherein the data communications link is a wireless radio frequency connection or a wired connection.

18. A hearing device system according to claim 14, wherein in the Rx-control mode the control unit of the second hearing device is configured to control mixing of the signal received from the first hearing device with a signal tapped from the signal path of the second hearing device, originating from the microphone of the second hearing device.

19. A hearing device system according to claim 14, wherein in the Rx-control mode the control unit of the second hearing device is configured to inhibit or attenuate the electric input signal from the microphone of the second hearing device.

20. A method of controlling a hearing device system in connection with a telephone handset, the hearing device system comprising at least a first hearing device and a second hearing device, and each of the hearing devices including a microphone for converting an acoustic input signal to an electric input signal, an output transducer for converting a processed electric output signal to an acoustic output signal, an electric signal path extending between the microphone and the output transducer, a transceiver for establishing a data communications link between the first and the second hearing device, and a control unit for implementing at least a first and a second control mode, and wherein at least the first hearing device includes a sensing unit configured to detect, whether the telephone handset is placed close to the first hearing device, the method comprising:

detecting whether the telephone handset is placed close to the first hearing device, if the telephone handset is detected, switching the first and second hearing device from a first, normal control mode to a second, Tx- and Rx- control mode, respectively, establishing in the second control mode the data communications link between the first hearing device and the second hearing device, transmitting an electric signal originating from the microphone of the first hearing device and derived from the signal path of the first hearing device to the second hearing device via the data communications link, controlling the output transducer of the first hearing device to inhibit or attenuate the acoustic output signal that is output by the output transducer of the first hearing device, and outputting the acoustic output signal of the second hearing device through the output transducer of the second hearing device, the acoustic output signal of the second hearing device including a signal originating from the electrical signal originating from the microphone of the first hearing device and transmitted from the first hearing device.

21. A method according to claim 20, wherein the electric signal derived from the signal path of the first hearing device and transmitted to the second hearing device during the second, Tx- and Rx-control mode includes a signal originating from a speaker of the telephone handset located at the first hearing device.

22. A method according claim 20, wherein the data communications link is based on wireless radio frequency communication.

23. A method according to claim 20, further including the step of transmitting via the data communications link instruction signals from the first hearing device to the second hearing device and vice versa.

24. A method according to claim 20 wherein the control unit of the first hearing device is adapted for transmitting via the data communications link instruction signals to the control unit of the second hearing device for setting the second hearing device in its appropriate control mode.

* * * * *